US007874858B2

(12) United States Patent
Atsumi

(10) Patent No.: US 7,874,858 B2
(45) Date of Patent: Jan. 25, 2011

(54) CONNECTOR

(75) Inventor: Sumito Atsumi, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/567,885

(22) Filed: Sep. 28, 2009

(65) Prior Publication Data

US 2010/0081332 A1 Apr. 1, 2010

(30) Foreign Application Priority Data

Oct. 1, 2008 (JP) ..... 2008-255910

(51) Int. Cl.
*H01R 13/64* (2006.01)

(52) U.S. Cl. ..... 439/248

(58) Field of Classification Search ..... 439/248, 439/247, 680, 638
See application file for complete search history.

(56) References Cited

U.S. PATENT DOCUMENTS 1,966,234 A * 7/1934 Ernest et al. ..... 439/248
3,091,748 A * 5/1963 Takes et al. ..... 439/248
3,753,212 A * 8/1973 Yamada et al. ..... 439/358
4,108,522 A * 8/1978 Favale ..... 439/357
4,711,507 A * 12/1987 Noorily ..... 439/292
4,808,115 A * 2/1989 Norton et al. ..... 439/79
5,279,507 A * 1/1994 Kameyama ..... 439/552
5,487,680 A * 1/1996 Yamanashi ..... 439/552
5,605,150 A * 2/1997 Radons et al. ..... 600/300
6,231,368 B1 * 5/2001 Murakami et al. ..... 439/352
6,354,855 B2 * 3/2002 Annequin ..... 439/248
6,475,015 B1 * 11/2002 Murakami et al. ..... 439/352
6,488,545 B1 * 12/2002 Meyer ..... 439/680
6,514,099 B2 * 2/2003 Endo ..... 439/489
6,595,793 B2 * 7/2003 Tsuji et al. ..... 439/352
6,600,105 B2 * 7/2003 Nakata et al. ..... 174/660
6,616,480 B2 * 9/2003 Kameyama ..... 439/587
6,848,925 B2 * 2/2005 Nishide ..... 439/247
7,284,785 B2 * 10/2007 Gotou et al. ..... 296/155
7,374,457 B1 * 5/2008 Oksengendler et al. ..... 439/660
7,575,473 B2 * 8/2009 Kodama et al. ..... 439/563
7,611,370 B2 * 11/2009 Ito et al. ..... 439/345
7,704,086 B2 * 4/2010 Gimbel et al. ..... 439/157
7,708,589 B2 * 5/2010 Shuey ..... 439/552
2008/0048479 A1 * 2/2008 Yoshida et al. ..... 297/410

FOREIGN PATENT DOCUMENTS

JP 2003-323941 A 11/2003

* cited by examiner

*Primary Examiner*—T C Patel
*Assistant Examiner*—Vladimir Imas
(74) *Attorney, Agent, or Firm*—Sughrue Mion, PLLC

(57) ABSTRACT

A connector, comprises a plurality of metal terminals; and a connector housing including a box-like body portion for receiving the plurality of metal terminals, a tubular portion within which the body portion is disposed, and an interconnecting portion interconnecting end portions of the body portion and the tubular portion, wherein the interconnecting portion includes a plurality of flat plate portions spaced from one another in a direction of a periphery of each of the tubular portion and the body portion, and a mountain-shaped portion projecting toward the inner side of the tubular portion, and the flat plate portions are smaller in thickness than the tubular portion.

8 Claims, 6 Drawing Sheets

CONNECTOR

BACKGROUND OF THE INVENTION

1. Field of the Invention

This invention relates to a connector used for connecting wires or the like.

2. Description of the Related Art

Various electronic equipments are mounted on an automobile that serves as a moving body. Therefore, wire harnesses for transmitting electric power, control signals, etc., to the electronic equipments are installed on the automobile. The electronic equipment and the wire harness are provided respectively with connectors, and are connected together through their connectors fitted together.

Each connector comprises a connector housing, and metal terminals received within the connector housing. When the two connectors are fitted together, the metal terminals in one connector housing are electrically connected respectively to the metal terminals in the other connector housing.

As the above-mentioned connector, there has been proposed, for example, the type of connector comprising a male type connector housing (hereinafter referred to as "male housing"), a female type connector housing (hereinafter referred to as "female housing") for fitting to the male housing, a holder for releasably receiving the female housing, a clamp mounted on the holder so as to mount this holder on a mounting member (see, for example, Patent Literature 1).

The male housing includes a terminal receiving portion for receiving male metal terminals, and a tubular hood portion extending from the terminal receiving portion. The female housing includes a body portion for receiving female metal terminals, and a tubular portion formed around the body portion in spaced relation thereto. The body portion and the tubular portion are interconnected at their end portions remote from the male housing.

The holder is formed into a tubular shape, and one longitudinal end of the holder is open for the insertion of the male housing therethrough, and the other end is closed by a mounting wall for mounting on the mounting member. An engagement hole in which the clamp can be engaged is formed through the mounting wall. The holder has an opening formed in that portion of its peripheral wall disposed adjacent to the mounting wall, and the female housing is inserted into the holder through this opening, and is received within the holder.

The clamp is made of a synthetic resin having elasticity. The clamp is engaged in the engagement hole formed in the mounting wall of the holder, and is thus mounted on the holder. The holder is displaceably mounted on the mounting member through the clamp mounted on the holder.

In the connector of the above construction, when the male housing is inserted into the holder, the clamp is elastically deformed, and therefore the holder is displaced relative to the mounting member, so that the center axis of the female housing within the holder is rendered parallel to the center axis of the male housing, that is, the female housing and the male housing are aligned with each other. Then, the hood portion of the male housing is inserted into a space between the tubular portion and the body portion of the female housing, and also the body portion of the female housing is received in the hood portion of the male housing, and thus the male housing and the female housing are fitted together. In the above connector, the female and male housings can thus be smoothly fitted together by the holder and the clamp.

Patent Literature 1: JP-A-2003-323941

In the above conventional connector, however, the female housing and the male housing are aligned with each other by the holder and the clamp, and therefore there have been encountered problems that the number of the component parts tend to increase and that the connector becomes large in size.

SUMMARY OF THE INVENTION

It is therefore an object of this invention to provide a connector which can be aligned with a mating connector with a simple construction without increasing the number of component parts.

In the first aspect of the invention, the interconnecting portion includes the plurality of flat plate portions spaced from one another in the direction of the periphery of each of the tubular portion and the body portion, and the mountain-shaped portion projecting toward the inner side of the tubular portion, and the flat plate portions are smaller in thickness than the tubular portion. Therefore, the interconnecting portion can be elastically deformed so as to displace or move the body portion toward and away from the inner surface of the tubular portion.

In the second aspect of the invention, the slit is formed through the mountain-shaped portion, and communicates the space, disposed outside the body portion and inside the tubular portion, with the outside of the tubular portion. Therefore, the mountain-shaped portion can be more easily elastically deformed.

As described above, in the first aspect of the invention, the interconnecting portion can be elastically deformed so as to displace or move the body portion toward and away from the inner surface of the tubular portion, and therefore if a fitting centerline (center axis) of the connector is disposed out of alignment with a fitting centerline of a mating connector at the time of fitting the two connectors together, the body portion within the tubular portion can be displaced so as to absorb the misalignment of the fitting centerlines of the two connectors. Therefore, the connector can be aligned with the mating connector with the simple construction without increasing the number of the component parts, and therefore can be smoothly fitted to the mating connector.

In the second aspect of the invention, the mountain-shaped portion can be more easily elastically deformed, and therefore the interconnecting portion can be positively elastically deformed so as to displace or move the body portion toward and away from the inner surface of the tubular portion. Therefore, when fitting the connector to the mating connector, the body portion within the tubular portion can be positively displaced so as to positively absorb the misalignment of its fitting centerline with the fitting centerline of the mating connector.

DESCRIPTION OF THE PREFERRED EMBODIMENTS

One preferred embodiment of a connector of the present invention will now be described with reference to FIGS. 1 to 6. The connector 1 of this embodiment is fitted to a mating connector 2 (shown in FIG. 1) so as to form a wire harness for installation on an automobile or the like.

Figure 1:
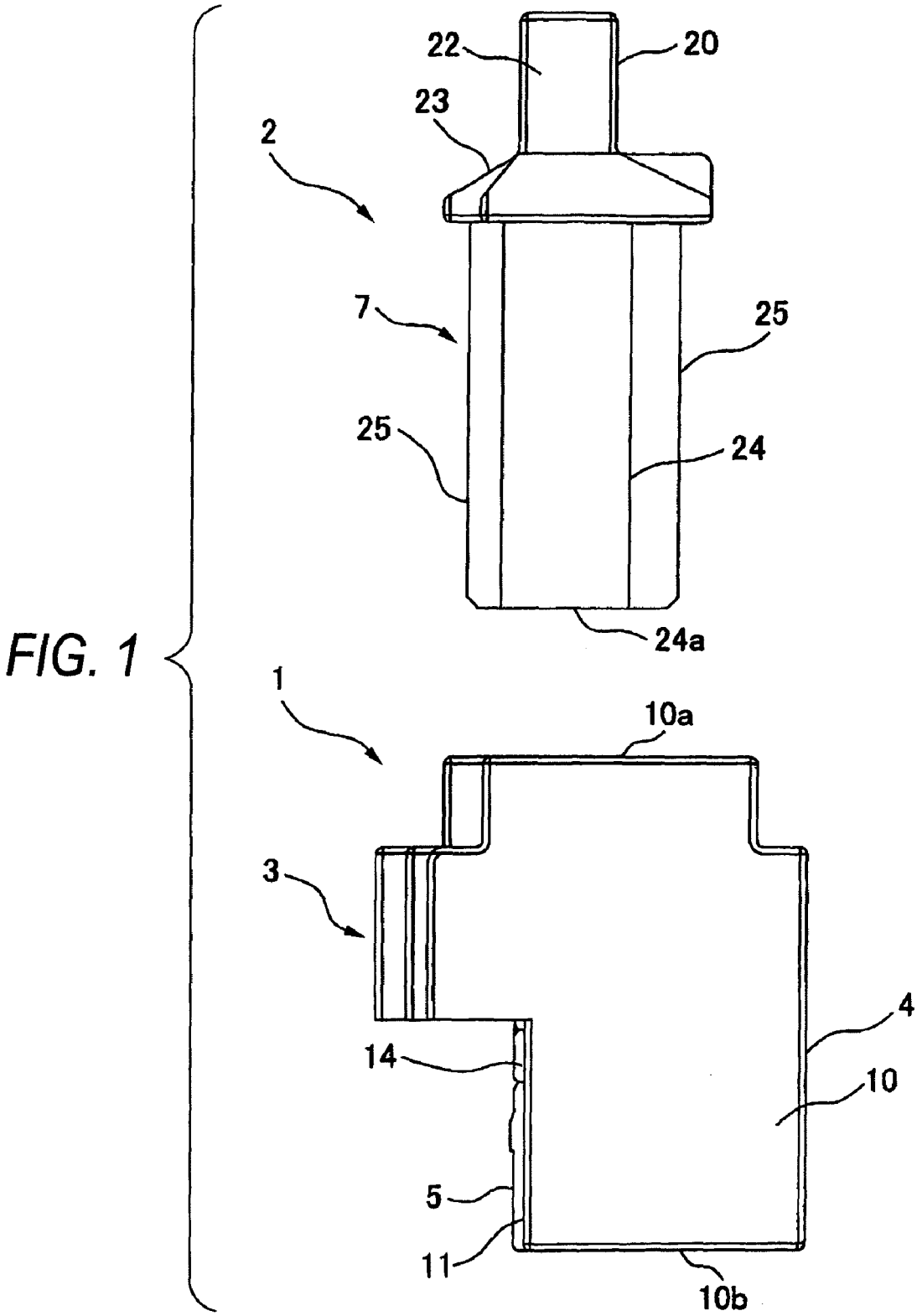
FIG. 1 is a side-elevational view showing one preferred embodiment of a connector of the present invention and a mating connector for fitting to the connector.
Figure 4:
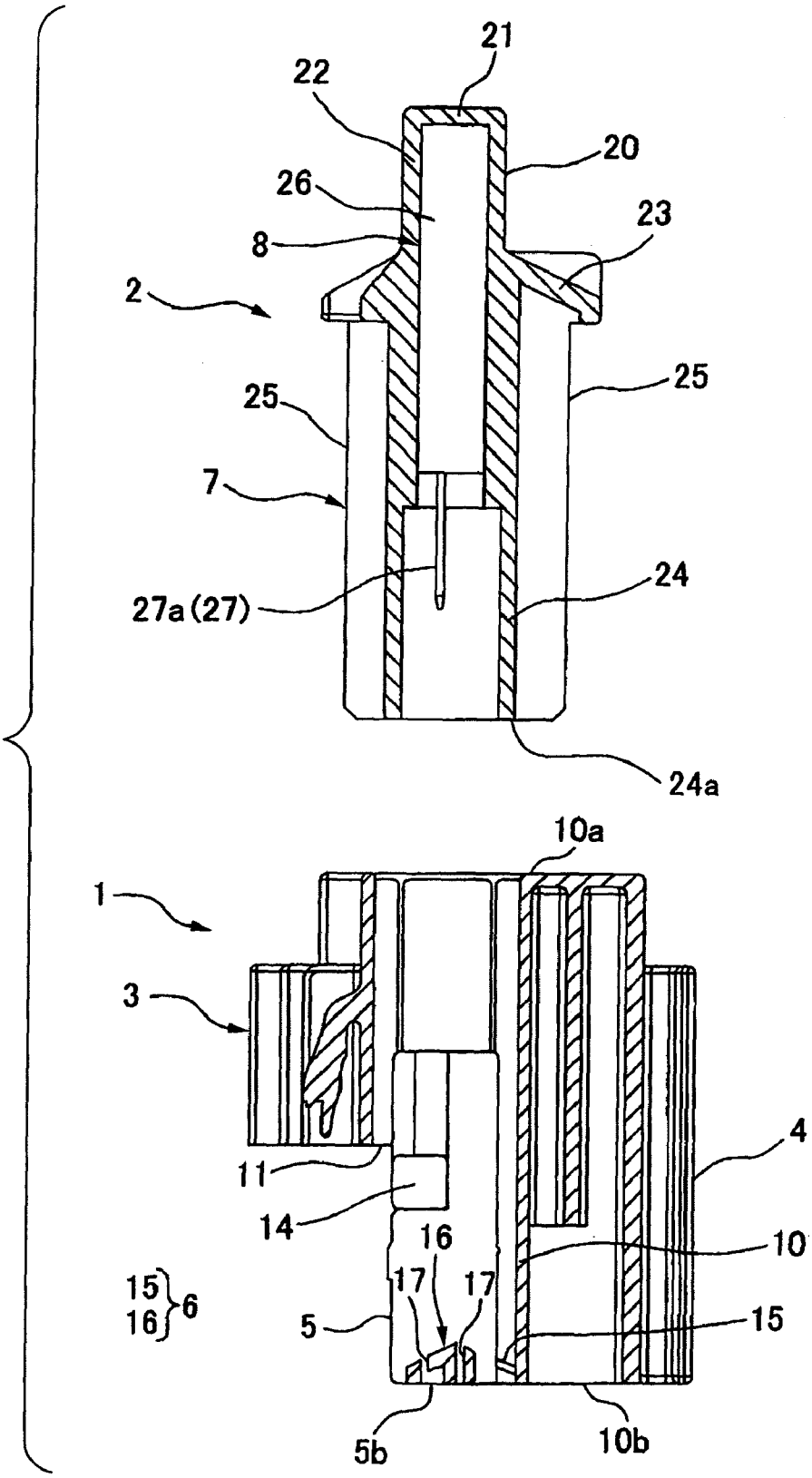
FIG. 4 is an explanatory view showing a cross-section of the female housing of the connector of FIG. 1 and a cross-section of a male housing of the mating connector.

As shown in FIGS. 1 and 4, the mating connector 2 comprises a male type connector housing (hereinafter referred to as "male housing") 7, and a switching unit 8 received within the male housing 7.

The male housing 7 is made of an insulating synthetic resin or the like, and includes a receiving portion 20 for receiving the switching unit 8, a tubular hood portion 24 extending from the receiving portion 20, and guide ribs 25. The receiving portion 20 is formed into a tubular shape having a closed top, and includes a top wall 21, and a peripheral wall 22 formed on and extending perpendicularly from an outer peripheral edge of the top wall 21. The receiving portion 20 has a flange portion 23 and a lock portion (not shown).

The flange portion 23 projects outwardly from the peripheral wall 22 of the receiving portion 20, and is formed on and around the outer periphery of the peripheral wall 22. When the male housing 7 is fitted to a female housing 3 (described later) of the connector 1, the flange portion 23 abuts against one end portion 10*a* of a tubular portion 4 of the female housing 3. The lock portion can be engaged with a lock reception portion formed at the tubular portion 4 of the female housing 3 of the connector 1 to hold the female housing 3 and the male housing 7 in the fitted condition.

The hood portion 24 has a tubular shape, and extends from the peripheral wall 22 of the receiving portion 20. A inserting-side distal end 24*a* of the hood portion 24 which is remote from the receiving portion 20, that is, which is to be inserted into the tubular portion 4 of the female housing 3 of the connector 1, is open to an outer surface of the hood portion 24 (that is, to an outer surface of the male housing 7). The hood portion 24 receives a body portion 5 (described later) of the female housing 3 of the connector 1 therein, and is received in the tubular portion 4 of the female housing 3.

The plurality of guide ribs 25 are formed on and project from the outer surfaces of the receiving portion 20 and hood portion 24. The guide ribs 25 have a generally prism-shape, and extend linearly from the flange portion 23 to the distal end 24*a* of the hood portion 24. The guide ribs 25 extend in the direction of insertion of the hood portion 24 into the tubular portion 4 of the female housing 3 of the connector 1, that is, in the direction of fitting of the male and female housings 7 and 3 to each other.

Here, the fitting direction means the direction of moving of the male housing 7 (of the mating connector 2) and the female housing 3 (of the connector 1) toward each other when fitting the male housing 7 and the female housing 3 together. In the illustrated embodiment, the fitting direction is parallel to a longitudinal direction of male tabs 27*a* (described later) of the switching unit 8 of the mating connector 2 and also to a longitudinal direction of female terminals (not shown) received within the female housing 3 of the connector 1.

The switching unit 8 comprises a flattened box-shaped resin seal body 26 made of a synthetic resin or the like, a circuit board (not shown) received within the resin seal body 26, a switching device (not shown) mounted on the circuit so as to effect an ON-OFF control of an electric current, and a connection terminal 27 mounted on the circuit board and connected to the switching device.

The connection terminal 27 is made of electrically-conductive metal, and includes a flat plate-like terminal body portion (not shown), and the plurality of parallel, spaced bar-like male tab 27*a* formed integrally with the terminal body portion. When the male housing 7 and the female housing 3 of the connector 1 are fitted together, the plurality of male tabs 27*a* are inserted respectively into terminal receiving chambers 13 of the female housing 3, and are electrically and mechanically connected respectively to the female terminals (not shown) received in the respective terminal receiving chambers 13.

Figure 2:
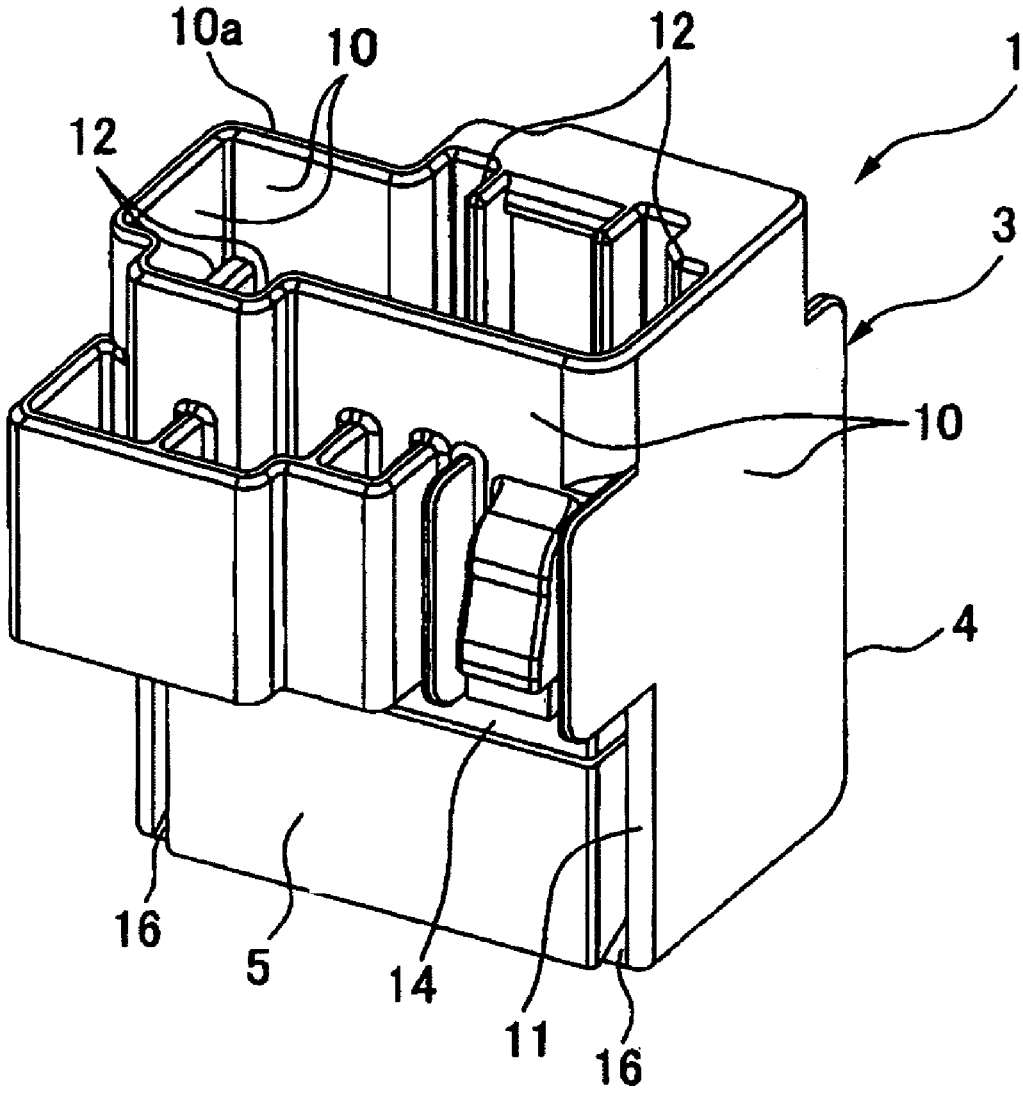
FIG. 2 is a perspective view showing a female housing of the connector of FIG. 1.
Figure 3:
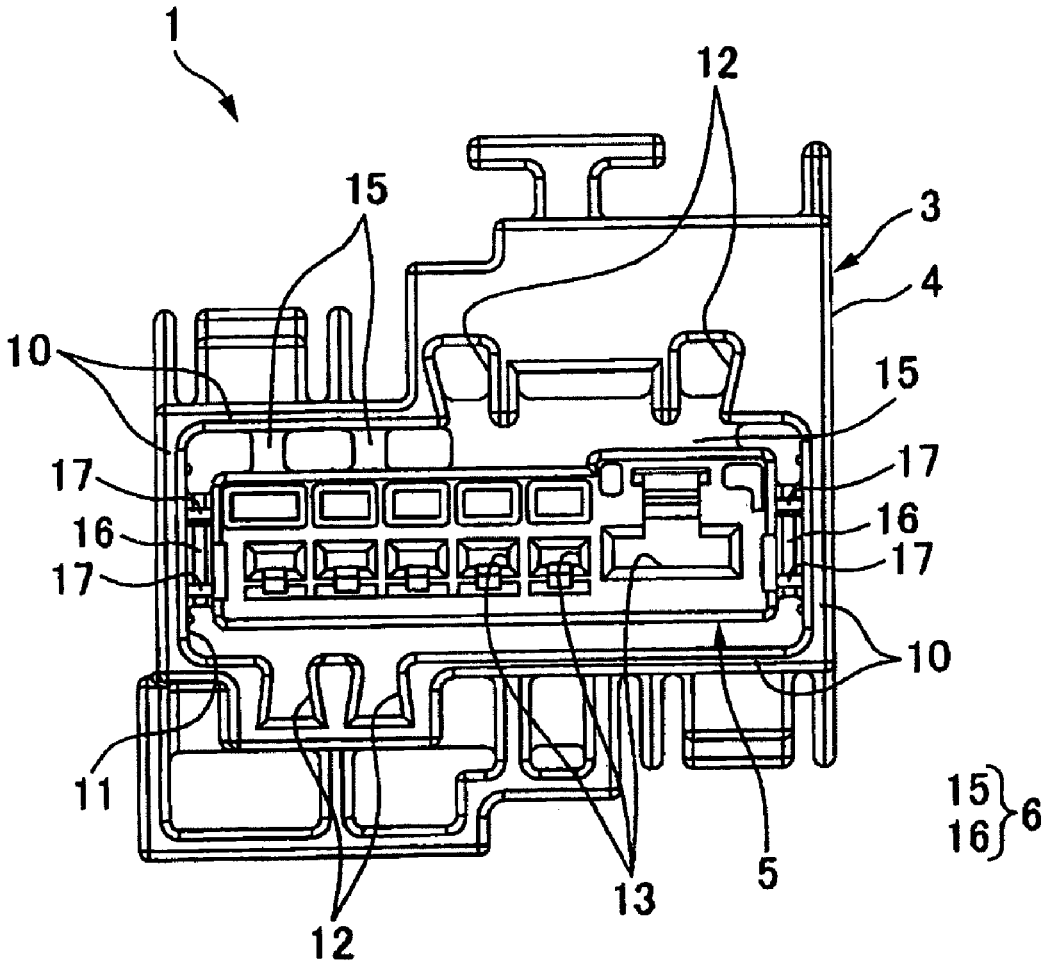
FIG. 3 is a top plan view of the female housing of the connector of FIG. 1.

As shown in FIGS. 1 to 3, the connector 1 comprises the plurality of female metal terminals (not shown and hereinafter referred to as "female terminals"), and the female type connector housing (hereinafter referred to as "female housing") 3.

Each of the female terminals is made of an electrically-conductive metal sheet, and includes a tubular electrical contact portion, and a wire connection portion formed integrally with and extending from the electrical contact portion. The male tab 27*a* of the connection terminal 27 is inserted into the electrical contact portion to be electrically connected thereto. A wire (not shown) is fixedly secured to the wire connection portion, and a conductor of the wire is electrically connected to this wire connection portion.

When the female housing 3 and the male housing 7 are fitted together, the male tabs 27*a* of the connection terminal 27 are inserted respectively into the electrical contact portions of the female terminals, so that the female terminals are electrically and mechanically connected to the connection terminal 27. These female terminals correspond to "metal terminals" recited in the appended claims.

The female housing 3 is made of an insulating synthetic resin or the like, and includes the tubular portion 4 defining an outer wall, the box-like body portion 5 disposed within the tubular portion 4, and an interconnecting portion 6 interconnecting the tubular portion 4 and the body portion 5, as shown in FIG. 3.

As shown in FIGS. 2 and 3, the tubular portion 4 has a generally square tubular shape, and has a peripheral wall 10 having a plurality of peripheral wall portions. One end portion 10*a* of the peripheral wall 10 of the tubular portion 4 which is to be opposed to the male housing 7 is open to the outer surface of the female housing 3 (Namely, the tubular portion 4 has an open upper end). The tubular portion 4 has the body portion 5 disposed therein, and an inner surface of the peripheral wall 10 is spaced from an outer surface of the body portion 5. The hood portion 24 of the male housing 7 is inserted into the tubular portion 4 through the one end portion 10*a* of the peripheral wall 10.

Part of the peripheral wall 10 of the tubular portion 4 is notched to form an opening 11 (having an inverted L-shape when viewed from one side of the tubular portion 4) such that part of the outer surface of the body portion 5 disposed within the tubular portion 4 is exposed to the exterior through this opening 11. The opening 11 extends to the other end portion 10*b* of the peripheral wall 10. The opening 11 is thus formed through the peripheral wall 10 of the tubular portion 4, and communicates a space, disposed outside the body portion 5 and inside the tubular portion 4, with the outside of the tubular portion 4.

The tubular portion 4 further includes the lock reception portion for fitting to the above-mentioned lock portion, guide groove portions 12 into which the guide ribs 25 can be inserted, respectively.

As shown in FIG. 3, the plurality of guide groove portions 12 are formed at the inner surface of the peripheral wall 10 of the tubular portion 4, and are recessed from this inner surface. The guide groove portions 12 extend from the one end portion 10*a* of the peripheral wall 10 of the tubular portion 4 to the other end portion 10*b* thereof. The guide groove portions 12 extend in the direction of insertion of the hood portion 24 of the male housing 7 into the tubular portion 4, that is, in the direction of fitting of the female housing 3 and male housing 7 to each other. The guide ribs 25 of the male housing 7 are inserted respectively into the guide groove portions 12, thereby enabling the female housing 3 and the male housing 7 to be fitted together in the proper direction, that is, in the proper posture.

The body portion 5 has a box-shape, and has the plurality of juxtaposed terminal receiving chambers 13 formed therein as shown in FIG. 3. The plurality of terminal receiving chambers 13 of the body portion 5 receive the respective female terminals (not shown) fixedly secured to the respective wires.

Each of the terminal receiving chambers 13 is a linear space formed within the body portion 5, and extends in the longitudinal direction of the body portion 5. The longitudinal direction of each terminal receiving chamber 13 is parallel to the direction of fitting of the male and female housings 7 and 3 to each other. Longitudinal opposite ends of each terminal receiving chamber 13 are open respectively to the upper and lower outer surfaces of the body portion 5. The plurality of terminal receiving chambers 13 are disposed parallel to one another.

A terminal lock portion 14 for preventing the withdrawal of the female terminals from the respective terminal receiving chambers 13 is formed at the body portion 5. The terminal lock portion 14 has a generally prism-shape, and extends in the direction of juxtaposition of the plurality of terminal receiving chambers 13. The terminal lock portion 14 is provided at that side surface of the body portion 5 exposed to the exterior through the opening 11 of the tubular portion 4, and can be moved between a projected position and a retracted position. The terminal lock portion 14 presses the female terminals against inner surfaces of the respective terminal receiving chambers 13, thereby preventing the female terminals from being withdrawn from the respective terminal receiving chambers 13.

The interconnecting portion 6 is provided at the other end portion 10*b* of the peripheral wall 10 of the tubular portion 4, and interconnects the inner surface of the peripheral wall 10 of the tubular portion 4 and the outer surface of the body portion 5. Namely, the interconnecting portion 6 interconnects the other end portion 10*b* of the peripheral wall 10 of the tubular portion 4 and that end portion 5*b* of the body portion 5 remote from the male housing 7. The interconnecting portion 6 includes a plurality of flat plate portions 15 spaced from one another in the direction of the periphery of each of the tubular portion 4 and the body portion 5, and a pair of mountain-shaped portions 16 projecting toward the inner side of the tubular portion 4.

The plurality of flat plate portions 15 are formed on and extend between the inner surface of that peripheral wall portion (disposed at the upper side in FIG. 3) of the peripheral wall 10, opposed to the opening 11 with the body portion 5 interposed therebetween, and the outer surface of the body portion 5 opposed to this inner surface. The plurality of flat plate portions 15 are spaced from one another in the direction of juxtaposition of the terminal receiving chambers 13 of the body portion 5. Each of the flat plate portions 15 is smaller in thickness than the peripheral wall 10 of the tubular portion 4.

The pair of mountain-shaped portions 16 are provided respectively at the opposite side surfaces of the body portion 5 facing away from each other in the direction of juxtaposition of the terminal receiving chambers 13. More specifically, one of the mountain-shape portions 16 is formed on and extends between one side surface of the body portion 5 and that peripheral wall portion of the peripheral wall 10 opposed to the one side surface of the body portion 5, while the other mountain-shaped portion 16 is formed on and extends between the other side surface of the body portion 5 and that peripheral wall portion of the peripheral wall 10 opposed to the other side surface of the body portion 5. Each of the two mountain-shaped portions 16 has a generally inverted U-shaped cross-section projecting from the other end portion 10*b* of the peripheral wall 10 of the tubular portion 4 toward the one end portion 10*a* thereof.

Each of the two mountain-shaped portions 16 has a plurality of slits 17. The plurality of slits 17 are formed through the mountain-shaped portion 16, and communicate the space, disposed outside the body portion 5 and inside the tubular portion 4, with the outside of the tubular portion 4.

When the female housing 3 of the connector 1 and the male housing 7 of the mating connector 2 are to be fitted together, first, the switching unit 8 is inserted into the receiving portion 20 of the male housing 7 to be received therein before the female and male housings 3 and 7 are fitted together.

Then, the female terminals each having the wire connected thereto are inserted respectively into the terminal receiving chambers 13 of the body portion 5 of the female housing 3, and then the terminal lock portion 14 of the body portion 5 is moved into the retracted position where the outer surface of the terminal lock portion 14 is disposed flush with the outer surface of the body portion 5, so that the terminal lock portion 14 presses the female terminals against the inner surfaces of the respective terminal receiving chambers 13, thereby preventing the female terminals from being withdrawn from the respective terminal receiving chambers 13. Namely, the female terminals received in the respective terminal receiving chambers 13 of the body portion 5 of the female housing 3 are retained in the respective terminal receiving chambers 13 by the terminal lock portion 14.

Then, the female housing 3 of the connector 1 and the male housing 7 of the mating connector 2 are opposed to each other as shown in FIG. 4. Then, the female housing 3 and the male housing 7 are moved toward each other, and subsequently the guide ribs 25 of the male housing 7 are inserted respectively into the guide groove portions 12 formed at the inner surface of the peripheral wall 10 of the tubular portion 4 of the female housing 3, and also the hood portion 24 of the male housing 7 is inserted between the tubular portion 4 and the body portion 5 of the female housing 3.

Figure 5:
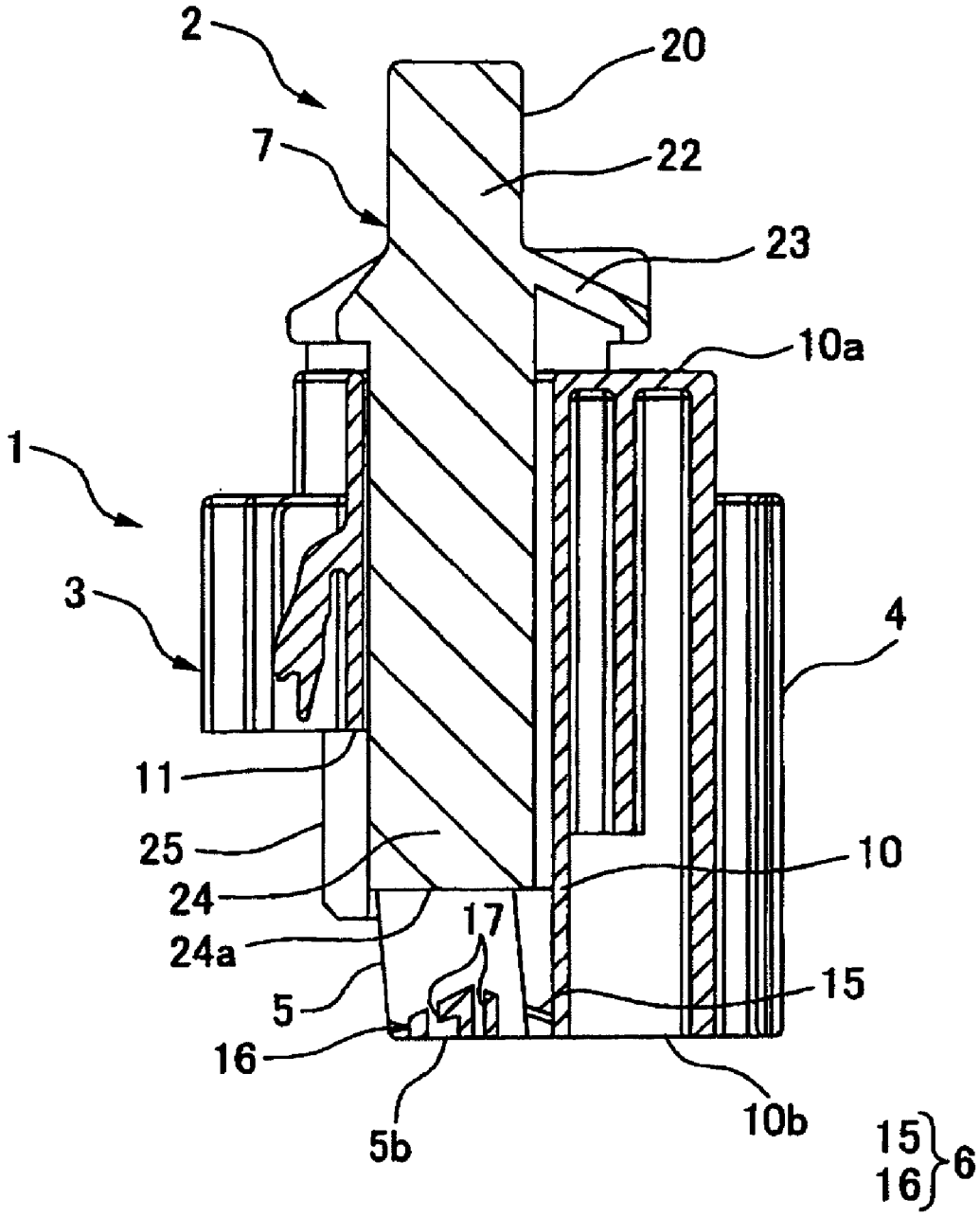
FIG. 5 is an explanatory view showing a process of fitting the female and male housings of FIG. 4 together.

At this time, if the hood portion 24 of the male housing 7 is inserted between the tubular portion 4 and the body portion 5 of the female housing 3 in such a manner that the center axis (fitting centerline) of the body portion 5 is disposed out of alignment with the center axis (fitting centerline) of the hood portion 24, the interconnecting portion 6 of the female housing 3 is elastically deformed so as to displace the body portion 5 so that that end portion of the body portion 5 close to the male housing 7 can intrude into the hood portion 24 of the male housing 7 (that is, the interconnecting portion 6 is elastically deformed so as to displace or move the body portion 5 toward the inner surface of the tubular portion 4) as shown in FIG. 5.

Figure 6:
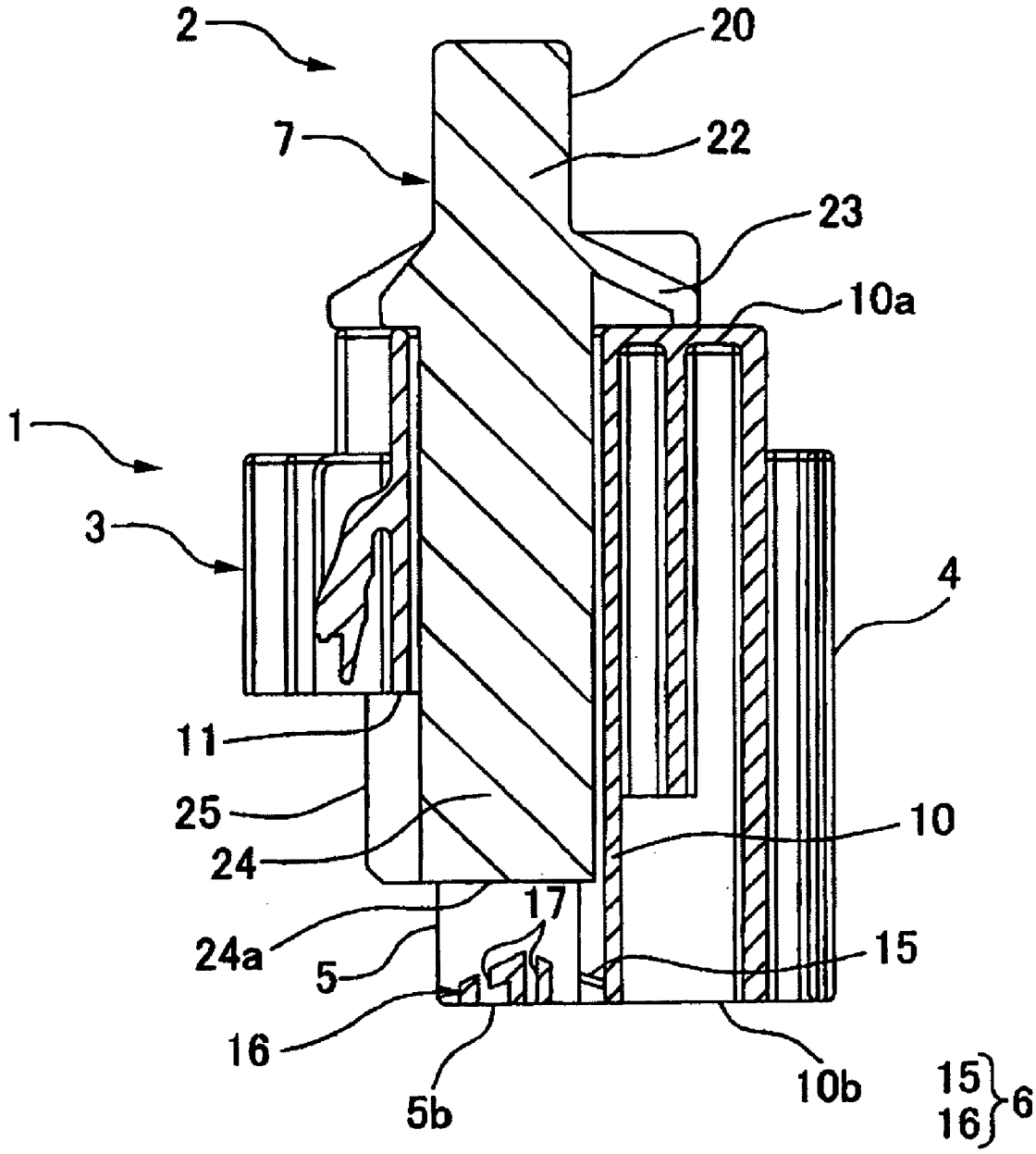
FIG. 6 is an explanatory view showing a condition in which the female and male housings of FIG. 4 are completely fitted together.

Then, when the female housing 3 and the male housing 7 are further moved toward each other, the flange portion 23 of the male housing 7 is brought into abutting engagement with the one end portion 10*a* of the peripheral wall 10 of the tubular portion 4 of the female housing 3, and also the lock portion formed at the receiving portion 20 of the male housing 7 is fitted to the lock reception portion formed at the tubular portion 4 of the female housing 3, as shown in FIG. 6.

As a result, the male tabs 27*a* of the connection terminal 27 of the switching unit 8 received within the receiving portion 20 of the male housing 7 are inserted respectively into the electrical contact portions of the respective female terminals received in the respective terminal receiving chambers 13 of the female housing 3, and thus the connection terminal 27 is electrically and mechanically connected to the female terminals. In this manner, the female housing 3 of the connector 1 and the male housing 7 of the mating connector 2 are fitted together.

In this embodiment, the interconnecting portion 6 of the female housing 3 includes the plurality of flat plate portions 15 spaced from one another in the direction of the periphery of each of the tubular portion 4 and the body portion 5, and the mountain-shaped portions 16 projecting toward the inner side of the tubular portion 4, and the flat plate portions 15 are smaller in thickness than the tubular portion 4.

Therefore, the interconnecting portion 6 can be elastically deformed so as to displace or move the body portion 5 toward and away from the inner surface of the tubular portion 4. Therefore, if the fitting centerlines of the two connectors 1 and 2 are disposed out of alignment with each other at the time of fitting the two connectors 1 and 2 together, the body portion 5 within the tubular portion 4 can be displaced so as to absorb the misalignment of the fitting centerlines of the two connectors 1 and 2. Therefore, the connector 1 can be aligned with the mating connector 2 with the simple construction without increasing the number of the component parts, and therefore can be smoothly fitted to the mating connector 2.

Each of the mountain-shaped portions 16 forming the interconnecting portion 16 has the slits 17 extending through the mountain-shaped portion 16 and communicating the space, disposed outside the body portion 5 and inside the tubular portion 4, with the outside of the tubular portion 4. Therefore, the mountain-shaped portion 16 can be more easily elastically deformed.

Therefore, the interconnecting portion 6 can be positively elastically deformed so as to displace or move the body portion 5 toward and away from the inner surface of the tubular portion 4. Therefore, when fitting the connector 1 to the mating connector 2, the body portion 5 within the tubular portion 4 can be positively displaced so as to positively absorb the misalignment of its fitting centerline with the fitting centerline of the mating connector 2.

The above embodiment merely shows a representative form of the present invention, and the present invention is not limited to the above embodiment. Namely, various modifications can be made without departing from the subject matter of the invention.

What is claimed is:

1. A connector for connecting with a mating connector, comprising:

a plurality of metal terminals; and a connector housing including a box-like body portion for receiving the plurality of metal terminals, a tubular portion within which the body portion is disposed, and an interconnecting portion interconnecting end portions of the body portion and the tubular portion so as to allow relative movement between the body portion and the tubular portion;

wherein the interconnecting portion includes:

a plurality of flat plate portions spaced from one another at least partially around a periphery of the body portion, and convex-shaped portion projecting toward an inner side of the tubular portion, and wherein the flat plate portions are smaller in thickness than the tubular portion.

2. The connector according to claim 1, wherein a slit is formed through the convex-shaped portion, and the slit communicates a space between the body portion and the tubular portion with a space that is located downstream from the tubular portion in an insertion direction of the mating connector.

3. The connector according to claim 1, wherein the body portion is fixed to the interconnecting portion, and the interconnecting portion is fixed to the tubular portion.

4. The connector according to claim 1, wherein the body portion, the tubular portion, and the interconnecting portion are monolithic.

5. The connector according to claim 1, wherein the body portion has a back end which is provided downstream in an insertion direction of the mating connector from a front end of the body portion, and wherein the interconnection portion is fixed to the back end of the body portion.

6. The connector according to claim 1, wherein the connector is a female-type connector.

7. The connector according to claim 1, wherein the flat plate portions extend from the body portion to the tubular portion.

8. The connector according to claim 1, wherein the mating connector has an inserting portion which is to be inserted into a space between the tubular portion and the body portion when the connector and the mating connector are connected together, and wherein the interconnecting portion is elastically deformable such that if the mating connector is misaligned during the connecting of the connector to the mating connector, the interconnecting portion will elastically deform causing the body portion to be displaced relative to the tubular portion so as to absorb the misalignment.

* * * * *